US007195178B2

(12) United States Patent
Frederiksen et al.

(10) Patent No.: US 7,195,178 B2
(45) Date of Patent: Mar. 27, 2007

(54) COOLING CEILING

(75) Inventors: Bjarne Frederiksen, Lemming (DK); Christian Neve, Hinnerup (DK)

(73) Assignee: Danfoss A/S, Nordborg (DK)

( * ) Notice: Subject to any disclaimer, the term of this patent is extended or adjusted under 35 U.S.C. 154(b) by 264 days.

(21) Appl. No.: 10/767,257

(22) Filed: Jan. 30, 2004

(65) Prior Publication Data

US 2004/0182944 A1 Sep. 23, 2004

(30) Foreign Application Priority Data

Jan. 31, 2003 (DE) ..... 103 03 827

(51) Int. Cl.
*B01F 3/02* (2006.01)
*G05D 21/00* (2006.01)

(52) U.S. Cl. ..... 236/44 C; 236/74 R

(58) Field of Classification Search ..... 62/150, 62/176.1, 324.6; 236/74 R, 44 C, 42
See application file for complete search history.

(56) References Cited

U.S. PATENT DOCUMENTS 4,659,009 A 4/1987 Newell, III

FOREIGN PATENT DOCUMENTS

EP 0 923 013 A1 6/1999
JP 2001349581 A * 12/2001

OTHER PUBLICATIONS

"Massgeschneiderte Regellösungen für Kühl- und Heizstrahldecken," *Zent-Frenger Gesellschaft für Gebäudetechnik mbH*, D-64646 Heppenheim, pp. 1-13.

FED Sensors Sequence Control of Cooling and Heating Circuit, Data Sheet, *Danfoss*, Jun. 1999, pp. 1-6.

* cited by examiner

*Primary Examiner*—Chen Wen Jiang
(74) *Attorney, Agent, or Firm*—Buchanan Ingersoll & Rooney PC

(57) ABSTRACT

The invention concerns a cooling ceiling installation with at least one heat exchanger, a valve, which controls the flow of a heat transfer medium through the heat exchanger and a mechanical control device, and a monitoring device. It is endeavored to provide a simple manner of avoiding a condensate formation on the cooling ceiling installation. For this purpose, the monitoring device has an adjustment drive, which mechanically displaces the control device to a state, in which the valve is closed.

14 Claims, 3 Drawing Sheets

COOLING CEILING

FIELD OF THE INVENTION

The invention concerns a cooling ceiling installation with at least one heat exchanger, a valve, which controls the flow of a heat transfer medium through the heat exchanger and a mechanical control device, and a monitoring device against condensate formation.

BACKGROUND OF THE INVENTION

Cooling ceiling installations are particularly known from modern office buildings. As cold air will fall down, a cooling ceiling offers a good opportunity of reducing the air temperature in an agreeable manner, that is, substantially without draught. For this purpose, a heat transfer medium, for example cold water, is led through the heat exchanger, which is located in the room ceiling. The air skimming across the heat exchanger transfers heat to the heat exchanger, that is, is cooled down.

However, problems with condensing water sometimes occur in connection with cooling ceilings. In office buildings, cooling ceilings are typically located above desks, computers and other workplaces. When air humidity condenses and gathers on the heat exchanger of the cooling ceiling, water can drop down, which is regarded to be unpleasant, when the drops hit a person. Dangerous situations may occur, when the drops penetrate into electrical devices, like computers and the like, and cause damage.

Therefore, a monitoring device against condensate formation has been provided. Such a monitoring device is, for example, described in the brochure "Massgeschneiderte Regellösungen für Kühl- und Heizstrahldecken" of the Zent-Frenger Gesellschaft für Gebäudetechnik mbH, D-64646 Heppenheim. With increasing room temperature, the valve controlling the flow of the heat transfer medium through the heat exchanger, is opened. Such a system is typically dimensioned for an inlet temperature of 14° C. and a return temperature of 16 to 19° C. With higher air humidity, there is, as mentioned above, a risk of condensed water formation on the cooling ceiling. This risk is not eliminated in that the valve is controlled, for example via a thermostatic controller. In order to counteract the condensate formation, the known case combines the room temperature control in an electronic manner with an integrated condensate monitoring. In principle, there are two different control forms. Measuring of the dew-point or the relative air humidity are made currently, and when a critical point is reached, the inlet temperature is increased, that is, an active condensate monitoring, or the valve is closed, so that the cooling ceiling is "turned off", that is, a passive condensate monitoring.

Common for both solutions is that they require the running of cables, which makes the installation more expensive and reduces the flexibility of the system. When it is desired to control the room temperature with an independent controller, a separate, active or passive condensate monitoring function must be established, which again makes the installation more expensive.

SUMMARY OF THE INVENTION

The invention is based on the task of providing a simple manner of avoiding the condensate formation.

With a cooling ceiling installation as mentioned in the introduction, this task is solved in that the monitoring device has an adjustment drive, which mechanically displaces the control device to a state, in which the valve is closed.

Thus, initially, a passive condensate monitoring is used. As soon as there is a risk that condensate will be formed, the valve is closed, so that no further heat transfer medium for cooling can be led through the heat exchanger. The room air increases the temperature of the heat exchanger so that no additional condensate formation occurs. A superior control will then no longer be required, as the monitoring device simply acts direct on the control device located on the valve and displaces it to the state mentioned, which, in the following, is also called "safety state". This term is mainly meant for differentiation in relation to other states. The change mentioned is a relatively simple measure, which can be realised with little effort. Otherwise, the control of the room temperature can remain uninfluenced. Merely for a short period, which is required to avoid the condensate formation, the heat exchanger of the cooling ceiling is rendered non-functional. As, however, in connection with air-conditioning processes, relatively long periods are always concerned, the relatively short break in the operation of the cooling ceiling can be accepted without problems. When the risk of condensate formation no longer exists, the safety state is ended, that is, the valve can be re-opened, when required by the increase in the room temperature.

Preferably, the adjustment drive is located on a unit formed by the valve and the control device. This gives several advantages. Firstly, the control device can be acted upon directly, that is, the adjustment drive does not have to overcome large mechanical "detours". This keeps the power consumption of the adjustment drive small. Further, practically no additional space is required. The adjustment drive can be mounted during the mounting process of the unit comprising the valve and the control device. Of course, the control device may also have a presetting device located outside the unit, for example a remote setting element or a remote sensor. Such elements are then connected with the control device via a capillary tube. This, however, has no influence on the fact that the adjustment drive can be connected with the unit.

In an alternative embodiment it is ensured that the control device has a sensing device located remotely from the valve, and that the adjustment drive is arranged on the sensing device. In this case, the desired value is not adjusted by the adjustment drive direct on the valve, but on a remote unit, the remote sensor. The transfer of the changed desired value then takes place via the signal path, which is also used for other signal transfers, namely in a hydraulic manner via a capillary tube. In principle, the remote sensor can have an embodiment, which is similar to that of a radiator valve thermostatic element. A pressure increase in the thermostatic element is led to the valve via the capillary tube and then causes a closing of the valve. In a similar manner, also an adjustment of the desired value by means of the adjustment drive causes a similar pressure change in the valve.

Preferably, the adjustment drive comprises a motor and a gear. The gear enables a gearing, so that the motor can be operated with a relatively low performance. This will, require some additional time for the adjustment of the control device. If, however, it keeps the power consumption of the motor small, it has no negative influence on the condensate formation.

Preferably, the motor is a rotary motor. A rotary motor can be operated at higher speeds, so that, due to the gear, also a weak output torque will permit the motor to provide sufficient power for the adjustment of the control device. Particularly useful is an electric motor, which can be supplied with power from a battery or another power source, for example mains voltage.

Preferably, the adjustment drive has an end position sensor indicating a completely closed state of the valve. This embodiment has the advantage that the valve can be moved to the completely closed state. As soon as this state has been reached, the sensor sends a corresponding signal to the adjustment drive, and the adjustment drive can stop working. In this case, it is ensured that heat transfer medium is no longer led through the heat exchanger. The adjustment drive works reliably, however, with a low power consumption. It is not operated beyond the end position of the valve, so that stress caused by a too extensive drive can be kept small.

It is preferred that the end position sensor detects, if a transfer element of the adjustment drive loads a tappet of the valve. Usually, the valve is opened in that a tappet is pushed in. For closing the valve, the force on the tappet subsides, and the valve closes under the effect of a closing spring. When now, this correlation between the tappet and a transfer element of the adjustment drive can be detected, this is a simple manner of achieving a reliable signal, which indicates the closing state of the valve. The sensor can have different embodiments. One possibility is to arrange a switch between the transfer element and the tappet, which opens, when the transfer element no longer loads the tappet. Also a pressure sensor can be imagined. Finally, it is possible to arrange a light barrier in such a manner that the lifting of the transfer element from the tappet will cause the appearance of a gap, which can be detected by the light barrier. Also other end position switches are, of course, possible.

Preferably, the monitoring device has a sensor in the form of a dew-point sensor or a humidity sensor. With such a sensor, it is easily recognised, when the risk of a condensate formation exists. When the sensor is an air humidity sensor, it is, of course, also expedient, when a temperature sensor is also available. However, in many room temperature controls, a temperature sensor is available anyway. It is merely required to bring together the signals of the temperature sensor and the humidity sensor measuring the air humidity, or a sensor is used, which measures the relative air humidity.

Preferably, the sensor is arranged on the heat exchanger or its inlet. This is particularly advantageous, when the sensor is a dew-point sensor. In this case, the risk of a condensate formation is recognised, where it exists, namely on the heat exchanger of the cooling ceiling.

Preferably, the monitoring device is located laterally next to a space, which forms an extension of a lifting movement of a valve element of the valve. The location of the monitoring device thus practically does not increase the height of the unit comprising the valve and the control unit. In most cases, the control device is located laterally next to the space mentioned anyway, so that here it is not necessary to keep the space free. The monitoring device can be arranged in this space, which is, in a manner of speaking, located in an angle between the valve and the control device.

Preferably, the adjustment drive adjusts a desired value. This is a relatively simple possibility. When the desired value is adjusted, for example when the risk of a condensate formation is increased, the valve opens later and does not permit the flow of the heat transfer medium, until a higher room temperature has been achieved. However, the higher room temperature reduces the inclination of condensate formation, so that with this simple measure the risk of the condensate formation can quickly be reduced. When the risk has been eliminated, the desired temperature can be reduced again, until a condensate formation starts threatening again.

Alternatively or additionally, the adjustment drive can mechanically block an active connection between the valve and the control unit. In this case, an opening of the valve is prevented completely or at least beyond a predetermined degree, as long as the risk of condensate formation exists.

Preferably, further to the heat exchanger a heating surface is provided, whose operating member is connected with the valve. Then it is possible, when the condensate formation becomes a threat, on the one hand to close the valve of the heat exchanger and on the other hand to activate the heating surface. This increases the room temperature for a short time, so that the risk of a condensate formation is reduced. In a manner of speaking, the heat exchanger and the heating surface are operated as a follow-up control.

It is preferred that the operating member is a heating valve, which is controlled by the valve with a follow-up control, a neutral zone being provided between the activation of the valve and the heating valve. The neutral zone prevents that the valve serving the cooling, and the heating valve used for heating, can open at the same time.

BRIEF DESCRIPTION OF THE DRAWINGS

In the following, the invention is described on the basis of preferred embodiments in connection with the drawings, showing.

DESCRIPTION OF THE PREFERRED EMBODIMENTS

Figure 1:
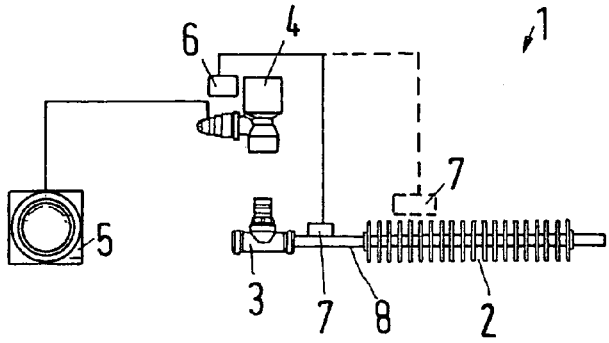
FIG. 1 a cooling ceiling installation
Figure 2:
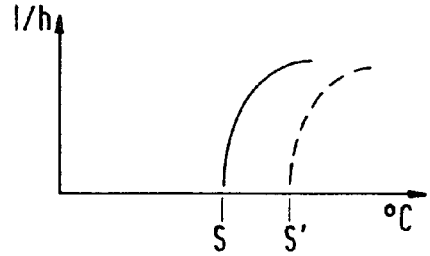
FIG. 2 a schematic view of a heat transfer medium flow over the temperature

FIG. 1 shows a cooling ceiling installation 1 with a heat exchanger 2, which is supplied via a merely schematically shown valve 3 with a heat transfer medium, for example water, at a temperature, which is lower than the room temperature. A control device 4 controls the valve 3. The control device 4 is, for example, a thermostatic operating element. Via a remote setting element 5, a desired value is specified for the control device 4. This desired value is shown in FIG. 2 as S. The remote setting element 5 can be a combination of a remote sensor and a setting element. However, it is also possible to arrange the remote sensor separately, or to dispense it, when it is not required, for example, when the temperature information can be found in another manner or at another place.

On the control device 4 is a monitoring device 6, which will be explained in detail below in connection with the FIGS. 5 and 6. The monitoring device 6 is connected with a sensor 7, which is located on the inlet 8 of the heat exchanger 2. The sensor 7 is, for example, a dew-point sensor or an air humidity sensor (Rh-sensor). It detects, whether there is a risk that condensed water will be formed on the heat exchanger 2. The monitoring device 6 is shown as a discrete device. However, it can also be integrated in other units, for example in the control device 4, the remote setting element 5 or a control device 11 described below.

An alternative position of the sensor 7, namely on the heat exchanger 2, is drawn with dotted lines. In this connection, it is expedient to locate the sensor 7, where the heat exchanger 2 is coldest, as here the risk of a condensate formation is largest.

When, by means of the sensor 7, the monitoring device 6 establishes that the risk of a condensate formation exists, it intervenes mechanically in the control device 4 and adjusts the desired value S upwards to a changed desired value S'. When, for example, the original desired value S was 22° C., the changed desired value S' is, for example, 24° C. This makes the control device 4 open the valve 3 later, that is, at a higher temperature. Thus, the heat exchanger 2 is no longer supplied with colder heat transfer medium. This has two effects. Firstly, the heat exchanger 2 and its inlet line, respectively, are heated by the ambient air, so that condensate, which might already have started forming, can evaporate again. Secondly, the temperature of the heat exchanger 2 is not further reduced, so that the risk of a further condensate formation is reduced.

Of course, the adjustment of the desired value to the value S' must be so large that, with the new desired value S', it is practically impossible for the valve 3 to open. The room temperature should thus not exceed the new desired value S', as this would again cause the risk of a condensate formation.

When, by means of the sensor 7, the monitoring device 6 establishes that the risk of a condensate formation has decreased again, the desired value S' can be returned to the original value S again. FIG. 2 shows the course of the flow amount over the temperature, with full line when based on the desired value S, and with dotted line when based on the desired value S'.

Otherwise, the desired value can still be set via the remote setting element 5. Also with a desired value set via the remote setting element 5, the monitoring device 6 remains active.

Figure 3:
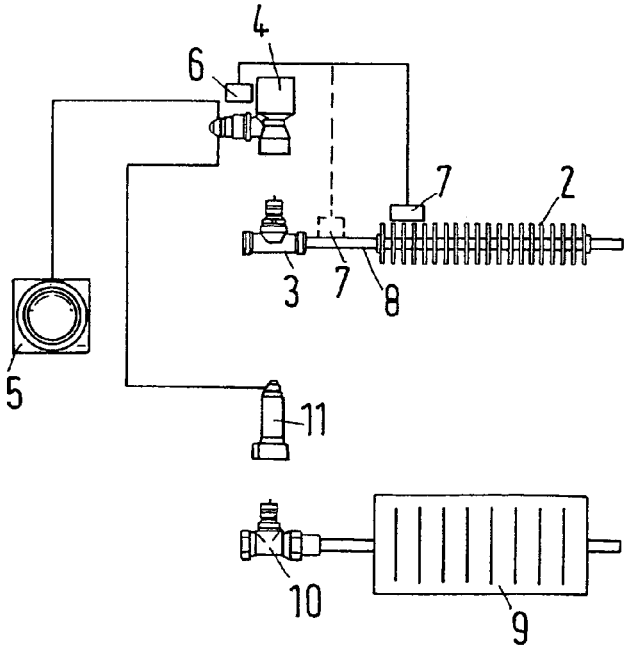
FIG. 3 a cooling ceiling installation with additional heating surface

FIG. 3 shows a modified embodiment, which differs from the embodiment according to FIG. 1 in that further to the heat exchanger 2 a heating surface 9 has been added, for example a radiator, which is controlled by a heating valve 10. The heating valve 10 is also activated by a control device 11, the control device 11 performing a follow-up control, that is, the heating valve 10 follows the adjustment of the valve 3. The follow-up control is made so that the heating valve 10 cannot open, when the valve 2 is still open. Thus, it is avoided that the heating surface 9 heats, while the heat exchanger 2 is still cooling.

Figure 4:
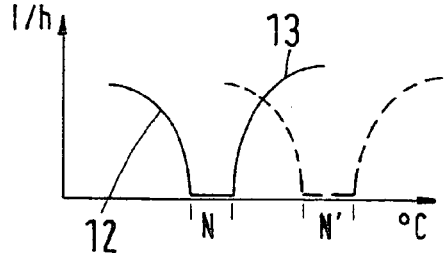
FIG. 4 a schematic view of the course between the heat transfer medium flow and the temperature FIG. 5 a first embodiment of a valve with control device FIG. 6 a section of a second embodiment of a valve with control device FIG. 7 a third embodiment of a valve FIG. 8 a fourth embodiment of a valve with remote setting element.

This is shown schematically in FIG. 4. In a left branch 12 is shown the volume flow of a heat transfer medium flowing through the heating surface 9. In a right branch 13 is shown the volume flow of another heat transfer medium flowing through the heat exchanger 2 to dissipate heat. Between them is a neutral zone N. When, by means of the sensor 7, which is fixed on the heat exchanger 2 or can be located on the inlet 8, the monitoring device 6 establishes that the risk of a condensate formation on the heat exchanger exists, the neutral zone N is displaced in the direction of a higher temperature, as shown by the neutral zone N' in FIG. 4.

Figure 5:
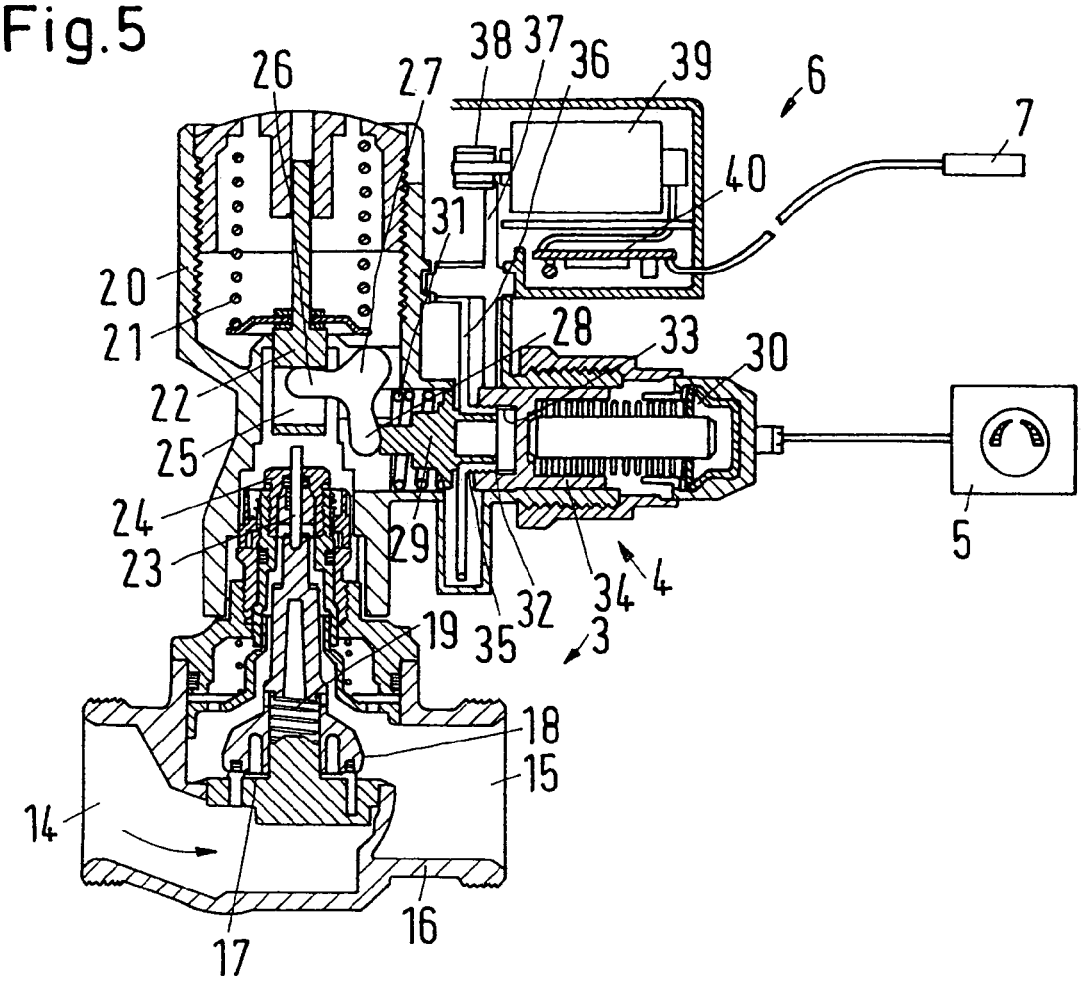

FIG. 5 is a schematic view of the embodiment of a valve 3 with control device 4 and monitoring device 6. In this connection it must be remembered that the valve 3 with control device 4 is combined in one unit, on which also the monitoring device 6 is fixed. Merely the sensor 7 and the remote setting element 5 are taken out.

The valve 3 has an inlet 14 and an outlet 15 in a housing 16. A valve seat 17 is located between the inlet 14 and the outlet 15. Cooperating with the valve seat 17 is a valve element 18, which is acted upon in the opening direction by a spring 19. Shown is a situation, in which the valve element 18 bears on the valve seat 17 and blocks the path from the inlet 14 to the outlet 15.

Usually, the valve element 18 is kept closed against the force of the spring 19 by a closing device 20, which comprises a spring 21, which acts upon a tappet 22, which cooperates with an operating pin 23, which is led through a stuffing box 24. In the situation shown in FIG. 5, the valve element 18 shall be lifted from the valve seat 17, and the operating pin 23 shall bear on the tappet 22. Shown is, however, a distance between the operating pin 23 and the tappet 22, to show that merely a pressure connection exists between these two parts, that is, a connection, which can merely transfer pressure forces.

The end of the tappet 22 facing the operating pin 23 is provided with an opening 25, in which an arm 26 of an angled lever 27 engages. The angled lever 27 has a second arm 28, which is loaded by pressure from a tappet 29, the tappet 29 being an operating member of the control device 4. The tappet 29 is driven via a thermostatic element 30, which displaces the tappet 29 to the left (in relation to FIG. 5), when the temperature increases, a return spring 31 being provided, which displaces the tappet 29 to the right again, when the temperature decreases.

The distance between the tappet 29 and the thermostatic element 30 is adjustable via a screw thread 32. The screw thread 32 has an inner thread 33, which is formed on an operating element 34, into which the thermostatic element 30 is inserted, and an outer thread 35, which is part of a gear wheel 36 bearing under pressure on the tappet 29. The gear wheel 36 is part of a gear, which comprises an additional gear wheel 37 and a pinion 38 on the output shaft of a motor 39. The motor 39 is part of the monitoring device 6. It is controlled by a control 40, which is connected with the sensor 7. In fact, the control 40 is the only electronics required here. It requires a relatively small space and can be located in the immediate proximity of the motor 39, which forms the drive for the monitoring device 6. The motor 39 is an electric motor, and like the control 40, it can be supplied by a battery. Of course, also an electrical supply from a supply mains is possible.

When a desired value S has been set by means of the remote setting element 5, the thermostatic element 30 expands, when the room temperature exceeds the desired value. Thus, the tappet 29 is displaced to the left, swinging the angled lever 27 so that its arm 26 presses the tappet 22 upwards against the force of the closing spring 21. Thus, the valve element 18 can lift off from the valve seat 17. Cold heat transfer medium can flow through the heat exchanger 2.

When, in this situation, it occurs that the sensor 7 establishes the risk of a condensate formation, the motor 39 is activated. It then turns the pinion 38 and the gear wheels 36, 37 engaging with the pinion 38 in such a manner that the distance between the tappet 29 and the thermostatic element 30 is reduced. In this way, the desired value is adjusted to a higher temperature. This lowers the valve element 18 towards the valve seat 17, and the supply of cold heat transfer medium to the heat exchanger is interrupted. However, the adjustment of the desired value must be so large that the room temperature does not exceed the new desired value, which consists of the old desired value plus the adjustment, while otherwise the valve 3 would open again anyway.

The embodiment according to FIG. 3 can be operated in a similar manner, when the control device L of the heating valve 10 is connected with the valve 3 or its control device 4, respectively, as known per se.

When the motor 39 has adjusted the desired value, the valve 3 is in a safety state.

Figure 6:
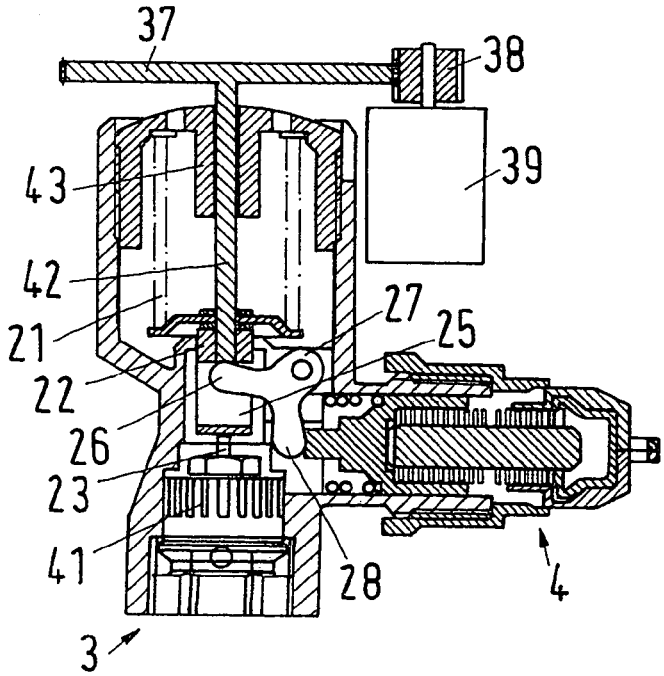

FIG. 6 shows a further possibility of setting such a safety state. Same parts as in FIG. 5 have the same reference numbers. In FIG. 6, the valve is only shown from the outside with its operation geometry 41.

The motor 39 has a pinion 38 acting via a gear wheel 37 on a threaded rod 42, which is screwed into the tappet 22 and supported in a housing part 43. When the threaded rod 42 is turned, the tappet 22 is displaced.

The tappet 22 acts upon the arm 26 of the angled lever 27 and converts its swinging movement to an axial movement of the valve pin, so that it can open and close. When the motor 39 is activated, to close the valve, the tappet in the FIG. is pressed downwards and the valve closes.

In this case, it is not important, if the room temperature exceeds the desired value of the control device 4. Also in case of an excess the valve 3 remains closed, as the arm 26 acts upon the operating pin 23 via the tappet 22, which keeps the valve element 18 bearing on the valve seat 17.

Figure 7:
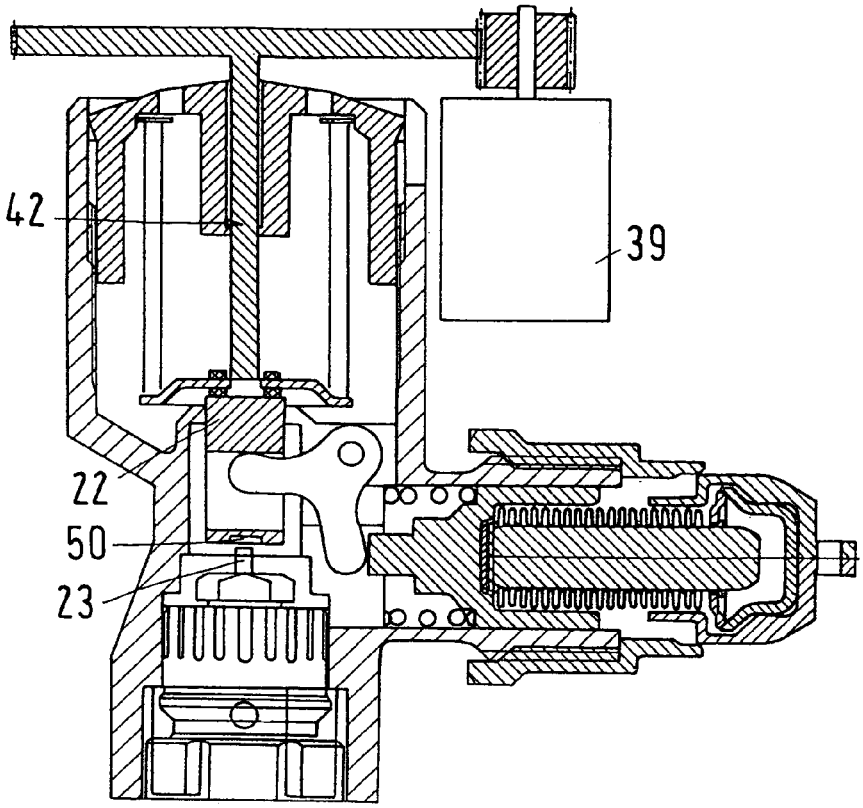

FIG. 7 shows an embodiment, which substantially corresponds to that in FIG. 6. Same parts therefore have same reference numbers.

A sensor 50 has been added, which is located between the tappet 22 of the adjustment drive and the operating pin 23. Of course, this sensor can also be used in the other embodiments. The sensor 50 can be a pressure sensor, an end position switch, a capacitive or an inductive sensor. Also an electric eye may be provided, which then generates a signal, when the tappet 22 lifts off from the operating pin 23.

Via a connection, which is not shown in detail, the sensor 50 is connected with the control of the motor 39. When the motor 39 is activated, it turns the spindle 42 for so long that the tappet 22 almost lifts off from the operating pin 23. As soon as a reduction of the load is established, the motor 39 stops working. This is a relatively simple way of establishing with large reliability that the valve is completely closed.

The sensor 50 can also be used for a further function. When the temperature increases and the control device opens the cooling valve, the sensor 50 indicates that the valve is open. The motor 39 can then be activated again to reset the desired value, that is, to end the condensate removal phase.

Figure 8:
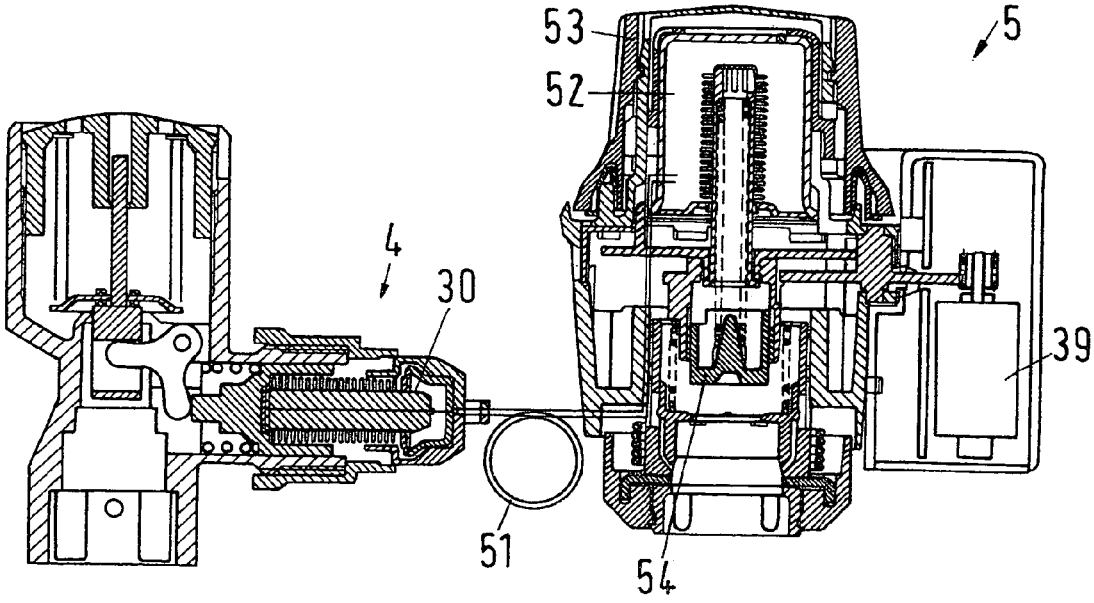

FIG. 8 shows a further embodiment, in which the remote setting element 5 is provided with the motor 39. The motor 39 adjusts an active connection between the thermostatic element of the remote setting element 5 and a tappet 54. The position of the thermostatic element 52 can be changed by means of a twist handle to change the desired value. Also further modifications can be made. For example, the volume in the element 52 can be increased by means of the motor to ensure that the cooling valve is closed. This amplifies or replaces the function of the closing spring.

A capillary tube 51 is located between the thermostatic element 52 in the remote setting element and the thermostatic element 30. In a manner of speaking, this capillary tube 51 transfers the desired value in a hydraulic manner from the remote setting element 5 to the control device 4.

What is claimed is:

1. Cooling ceiling installation with at least one heat exchanger, a valve, which controls the flow of a heat transfer medium through the heat exchanger and a mechanical control device, and a monitoring device against condensate formation, wherein the monitoring device has an adjustment drive which mechanically displaces the control device to a state in which the valve is closed.

2. Installation according to claim 1, wherein the adjustment drive is located on a unit formed by the valve and the control device.

3. Installation according to claim 1, wherein the control device has a sensing device located remotely from the valve and that the adjustment drive is arranged on the sensing device.

4. Installation according to claim 3, wherein the adjustment drive comprises a motor and a gear.

5. Installation according to claim 4, wherein the motor is a rotary motor.

6. Installation according to claim 1, wherein the adjustment drive has an end position sensor indicating a completely closed state of the valve.

7. Installation according to claim 6, wherein the end position sensor detects, if a transfer element of the adjustment drive loads a tappet of the valve.

8. Installation according to claim 1, wherein the monitoring device has a sensor in the form of a dew-point sensor or a humidity sensor.

9. Installation according to claim 8, wherein the sensor is arranged on the heat exchanger or an inlet of the heat exchanger.

10. Installation according to claim 1, wherein the monitoring device is located laterally next to a space, which forms an extension of a lifting movement of a valve element of the valve.

11. Installation according to claim 1, wherein the adjustment drive adjusts a desired value.

12. Installation according to claim 1, wherein the adjustment drive mechanically blocks an active connection between the valve and the control unit.

13. Installation according to claim 1, wherein further to the heat exchanger a heating surface is provided, whose operating member is connected with the valve.

14. Installation according to claim 13, wherein the operating member is a heating valve, which is controlled by the valve with a follow-up control, a neutral zone being provided between the activation of the valve and the heating valve.

* * * * *